US007167668B2

(12) United States Patent
Sekiguchi

(10) Patent No.: US 7,167,668 B2
(45) Date of Patent: Jan. 23, 2007

(54) DEVELOPMENT DEVICE

(75) Inventor: Hajime Sekiguchi, Chiba-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 137 days.

(21) Appl. No.: 11/046,806

(22) Filed: Feb. 1, 2005

(65) Prior Publication Data

US 2005/0175376 A1 Aug. 11, 2005

(30) Foreign Application Priority Data

Feb. 10, 2004 (JP) ..... 2004-033578

(51) Int. Cl.
*G03G 15/08* (2006.01)

(52) U.S. Cl. ..... 399/258; 399/260

(58) Field of Classification Search ..... 399/258, 399/260, 262, 224, 229
See application file for complete search history.

(56) References Cited

U.S. PATENT DOCUMENTS

| | | | | |
|---|---|---|---|---|
| 5,822,653 | A * | 10/1998 | Ishii | 399/262 |
| 5,915,155 | A * | 6/1999 | Shoji et al. | 399/262 |
| 5,918,092 | A | 6/1999 | Hama | 399/227 |
| 5,966,574 | A * | 10/1999 | Ui et al. | 399/258 |
| 6,456,809 | B1 | 9/2002 | Sekiguchi | 399/254 |
| 6,735,410 | B1 | 5/2004 | Sekiguchi | 399/269 |
| 2005/0175376 | A1 | 8/2005 | Sekiguchi | 399/258 |

FOREIGN PATENT DOCUMENTS

| | | |
|---|---|---|
| JP | 10-149012 | 6/1998 |

* cited by examiner

*Primary Examiner*—Susan Lee
(74) *Attorney, Agent, or Firm*—Fitzpatrick, Cella, Harper & Scinto

(57) ABSTRACT

A development device includes developer accommodation vessels in which developers having magnetism are accommodated, development units for developing electrostatic images on an image bearing member with the developers, developer replenishment paths for communicating the developer accommodation vessels with the development units and supplying the developers to the development units from discharge ports, transport members rotatably disposed in the developer replenishment paths to transport the developers to the development units, a drive unit for driving the transport members, a movement body for moving the developer accommodation vessels, the development units, and the developer replenishment paths while holding them, shield members movable integrally with the transport members and capable of shielding the discharge ports, and magnetic seal members disposed to the developer replenishment paths to hold the developers by magnetic fields formed between the magnetic seal members and the shield members when the shield members are located at positions confronting with the magnetic seal members, wherein the drive unit is controlled such that the shield members stop at the confronting positions when the transport members are stopped.

9 Claims, 8 Drawing Sheets

(a)

(b)

(a)

(b)

(a)

(b)

DEVELOPMENT DEVICE

BACKGROUND OF THE INVENTION

1. Field of the Invention

The present invention relates to a development device used in image forming apparatuses such as a copy machine, a printer, a facsimile, and the like that form an image by an electrophotographic system.

2. Related Background Art

Heretofore, in image forming apparatuses such as a copy machine, a printer, a facsimile, and the like that form a color image by an electrophotographic system, there is known a multi-transfer system which includes yellow, magenta, cyan, and black development units, sequentially overlaps and transfers the respective color toner images, which are developed on an image bearing member such as a photosensitive drum, and the like, onto a transfer member or sequentially overlaps and transfers them onto an intermediate transfer member, and forms a full-color image by transferring them onto an image transfer member at once.

In the image forming apparatus, when the toner in the development units is exhausted, fresh toner is supplied (replenished) to the development units from toner cartridges (toner replenishment vessels) in which the fresh toner is accommodated.

In for example, a technology disclosed in Japanese Patent Application Laid-Open No. 10-149012, toner is replenished to development units from respective toner cartridges through toner transport pipes (toner replenishment paths), which are interposed between the development units and the toner cartridges, and toner transport screws (supply augers) disposed in the toner transport pipes.

An image forming operation executed by the technology disclosed in Japanese Patent Application Laid-Open No. 10-149012 will be explained using FIGS. 7 and 8.

FIG. 7 is a side sectional view showing a schematic arrangement of a conventional rotary development device. In FIG. 7, the conventional rotary development device 50 includes a plurality of development units 52 (yellow, magenta, cyan, and black development units in FIG. 7,) mounted on a rotatable support frame 51, a plurality of toner replenishment vessels 53 mounted on the support frame 51 adjacent to the development units 52, toner transport pipes 55, which are disposed approximately in parallel with a rotary shaft 54 of the support frame 51 and causes the development units 52 to communicate and couple with the toner replenishment vessels 53 adjacent to the development units 52, and toner transport screws 56 for transporting fresh toner in the toner transport pipes 55 from the toner replenishment vessels 53 to the development units 52.

FIG. 8 is a plan view explaining a lengthwise arrangement of the conventional rotary development device 50. After the fresh toner accommodated in the toner replenishment vessels 53 is transported into the toner transport pipes 55 by toner transport means 57 in the toner replenishment vessels 53, it is supplied to the respective development units 52 by the toner transport screws 56 in the toner transport pipes 55.

In the arrangement in which the development units 52 are disposed approximately in parallel with the rotary shaft 54 of the rotatable support frame 51 (hereinafter, referred to as a rotary development system), a phenomenon occurs in that the toner in the toner transport pipes 55 is shifted by the rotation (hereinafter, referred to as revolution) of the support frame 51 for switching the development units 52 with respect to an image bearing member 58. That is, when the rotary development device 50 is revolved to switch the development units, there is a possibility that toner is excessively replenished by the toner transport screws 56 in the toner transport pipes 55 or toner flows back into the toner replenishment vessels 53 depending on the winding direction of the toner transport screws 56. When toner is excessively replenished to the development units 52 or is caused to flow back into the toner replenishment vessels 53, it is unstably replenished to the development units 52.

To cope with the above problem, in the technology disclosed in Japanese Patent Application Laid-Open No. 10-149012, the winding direction of the toner transport screws 56 is arranged such that when the rotary development device 50 is revolved to switch the development units, the toner shifts in the direction from the development units 52 to the toner replenishment vessels 53.

The toner transport screws 56 whose winding direction is arranged to shift the toner in the direction from the development units 52 to the toner replenishment vessels 53 is effective to prevent the excessive replenishment of the toner to the development units 52 when the rotary development device 50 is revolved as described above. However, there is a possibility that a toner replenishing time is increased or an amount of replenished toner is dispersed.

More specifically, in the arrangement for replenishing toner disclosed in Japanese Patent Application Laid-Open No. 10-149012, when the toner transport screws 56 begin to rotate to replenish toner to the development units 52, the toner in the vicinity of toner inlets of the development units 52 is transported to the development units 52. However, toner is transported from the development units 52 to the toner replenishment vessels 53 at all times when the rotary development device is revolved as described above even if the rotation of the toner transport screws 56 is stopped, thereby the amount of toner in the vicinity of the toner inlets is reduced. Accordingly, when toner is replenished, the rotating time of the toner transport screws 56 must be increased in correspondence with the amount of reduced toner.

Further, since the amount of toner shifted in the toner transport pipes 55 by the revolution of the rotary development device described above is also affected by the amount of toner in the toner replenishment vessels 53, toner cannot be replenished to the development units 52 in a predetermined amount. Accordingly, there is a possibility that the amount of replenished toner is dispersed. When, for example, the amount of toner in the toner replenishment vessels 53 is reduced, toner is liable to shift in the revolution and thus the toner in the vicinity of the toner inlets is transported to the development units 52, thereby the amount of toner in the vicinity of the toner inlets is reduced. In contrast, when a large amount of toner is accommodated in the toner replenishment vessels 53, a small amount of toner is shifted. As a result, since the amount of toner replenished to the development units 52 is dispersed due to the amount of toner in the toner replenishment vessels 53, an image is unstably developed on the image bearing member 58 by the development units 52 and thus an image density is also made unstable, which adversely affects an output image.

SUMMARY OF THE INVENTION

Accordingly, an object of the present invention is to stably replenish toner to development units by preventing excessive replenishment of toner to the development units and back flow of toner to developer accommodation vessels even if the development units are moved.

A preferable development device for achieving the above object includes developer accommodation vessels in which developers having magnetism are accommodated; development units for developing electrostatic images on an image bearing member with the developers; developer replenishment paths for communicating the developer accommodation vessels with the development units and supplying the developers to the development units from discharge ports; transport members rotatably disposed in the developer replenishment paths to transport the developers to the development units; drive means for driving the transport members; a movement body for moving the developer accommodation vessels, the development units, and the developer replenishment paths while holding them; shield members movable integrally with the transport members and capable of shielding the discharge ports; magnetic seal members disposed to the developer replenishment paths to hold the developers by magnetic fields formed between the magnetic seal members and the shield members when the shield members are located at positions confronting with the magnetic seal members; and a control means for controlling the drive means such that the shield members stop at the confronting position when the transport members are stopped.

DETAILED DESCRIPTION OF THE EMBODIMENT

Preferable embodiments of the present invention will be exemplarily explained below in detail with reference to the drawings. However, the sizes, the materials, and the shapes of components described in the following embodiments, and the relative positions, and the like of them are to be appropriately changed depending on the arrangement and the various conditions of apparatuses to which the present invention is applied, and the scope of the present invention is not limited only to those shown below.

[First Embodiment]

Developer replenishment units according to a first embodiment of the present invention and an image forming apparatus including them will be explained using FIGS. 1 to 4. In the first embodiment, the developer replenisher in the image forming apparatus including a rotary development device will be exemplarily explained. The image forming apparatus including the rotary development device will be briefly explained first, and then the developer replenisher according to the present invention will be explained in detail.

Figure 4:
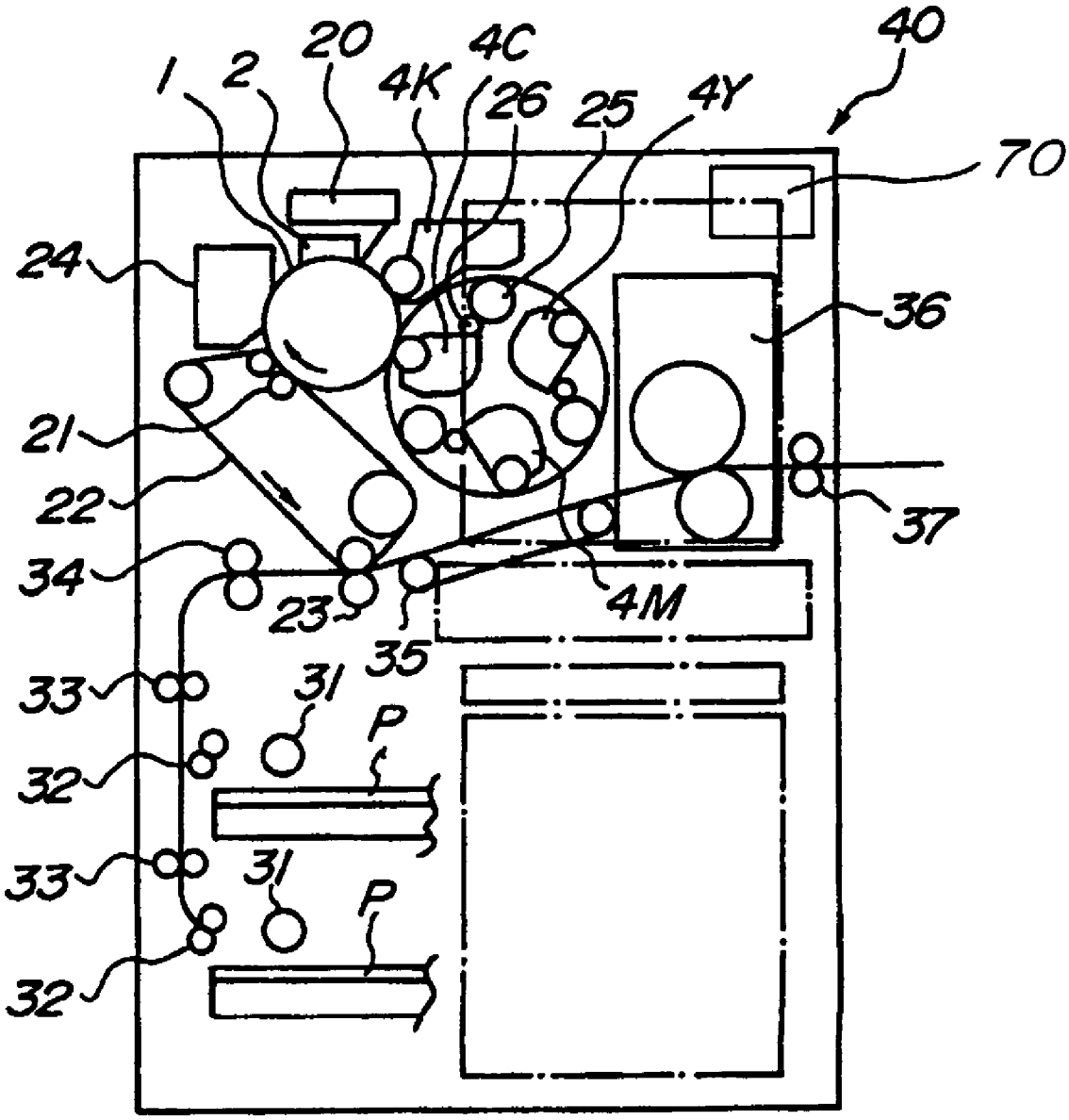
FIG. 4 is a schematic sectional view of an image forming apparatus having a rotary development device.

First, FIG. 4 shows a schematic sectional view of the image forming apparatus including the rotary development device to explain an arrangement of the image forming apparatus and an image forming operation. In the image forming apparatus 40 shown in FIG. 4, a yellow development unit 4Y, a cyan development unit 4C, and a magenta development unit 4M each using two-component toner, and the like as a developer are mounted on the rotary development device 4 which can rotatingly switch the plurality of development units. Reference numeral 4K denotes a black development unit disposed as a simple body separately from the rotary development device 4.

The rotary development device 4 includes a plurality of toner cartridges 25 (developer accommodation vessels) and developer replenishers 26 for replenishing toner to the respective development units from the toner cartridges 25. The developer replenishers 26 in the rotary development device 4 will be explained later in detail. However, toner can be stably replenished by replenishing it from the toner cartridges 25 using the developer replenishers 26 according to the first embodiment, thereby an image having a stable image density can be formed.

In the image forming apparatus 40, an electrostatic latent image is formed by an exposure unit 20 on a photosensitive drum 1 as an image bearing member charged by a charger 2. The electrostatic latent image formed on the photosensitive drum 1 is transported to a development section composed of the respective color development units, and a toner image is formed and (primarily) transferred onto a transfer belt 22 as an intermediate transfer member by primary transfer rolls 21. In a color image, the operation up to the primary transfer is repeated four times. Each time the electrostatic latent image is formed on the photosensitive drum 1, each color development unit (the development unit 4C in FIG. 4) in the rotary development device 4 is rotatingly moved (revolved) to a development position and develops the electrostatic latent image, thereby toner images are sequentially formed on the transfer belt 22. On the completion of the development and the primary image transfer executed by the respective development units in the rotary development device 4, development and primary image transfer are executed by the black development unit 4K as the simple body, thereby a toner image having the four overlapped colors is formed on the transfer belt 22.

Next, the multi-toner image on the transfer belt 22 is transferred at once onto a sheet P as an image transfer member transported by sheet transport units 31, 32, 33, and 34 (secondary transfer). The sheet P, onto which the toner image is transferred, is transported to a fixing means 36 by a transport belt 35, the toner image is fixed by the fixing means 36, and the sheet P is discharged to the outside of the image forming apparatus 40 by discharge rollers 37, thereby a series of the image forming operation is finished. Note that the toner remaining on the photosensitive drum 1 in the primary transfer is removed by a drum cleaner 24, and the toner remaining on the transfer belt 22 in the secondary transfer is removed by a belt cleaner.

Figure 1:
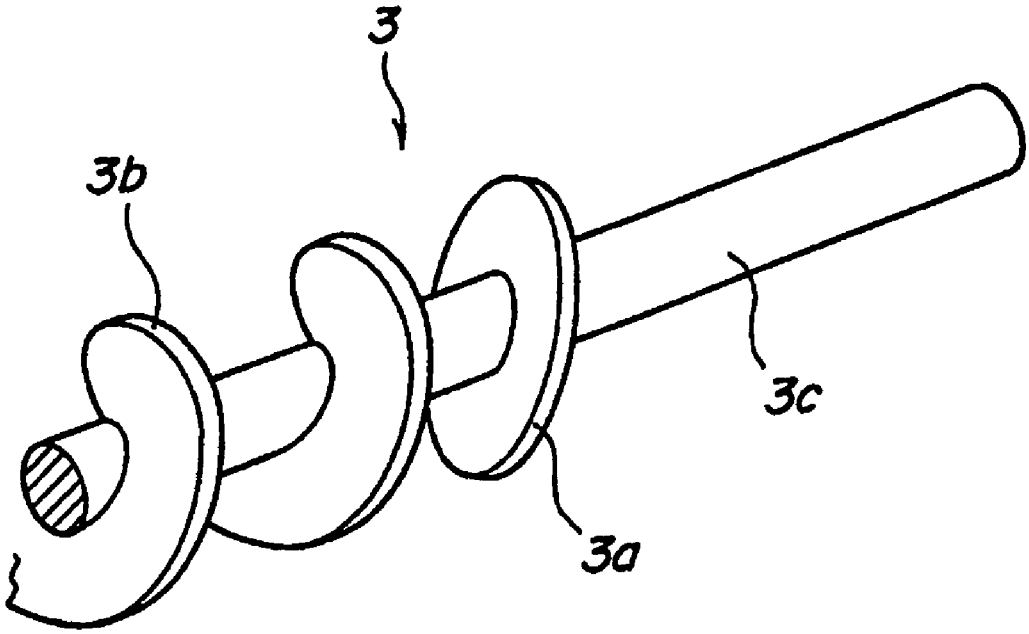
FIG. 1 is a perspective view of a toner transport screw in a developer replenisher according to a first embodiment.

Next, the developer replenisher disposed to the rotary development device will be explained in detail. FIG. 1 is a perspective view of a toner transport screw in the developer replenisher according to the first embodiment, FIG. 2 is a perspective view of the toner transport screw according to the first embodiment when it is at rest, FIG. 3A is a perspective view explaining the toner transport screw according to the first embodiment when it is at rest, and FIG. 3B is a sectional view explaining the toner transport screw while it replenishes toner (in rotation).

As shown in FIGS. 1 to 3A and 3B, the developer replenisher according to the present invention includes a toner transport pipe 6 as a developer replenishment path and a toner transport screw 3 as a developer transport means. The toner transport pipe 6 causes the toner cartridge 25 (refer to FIG. 4), in which developer is accommodated, to communicate with the development unit which forms an image on the photosensitive drum 1 (refer to FIG. 4) by the developer, and the toner transport screw 3 transport the developer while rotating in the toner transport pipe 6.

As shown in FIG. 1, the toner transport screw 3 as the developer transport means includes a screw portion 3*b* disposed to a shaft portion 3*c* so as to transport toner. The toner transport screw 3 further includes a magnetic shutter portion 3*a* as a developer shutter member for opening or shielding a toner discharge port 6*a* as a developer discharge port for discharging the developer from the toner transport pipe 6 to the development unit. The magnetic shutter portion 3*a* is disposed at a position near to the toner discharge port 6*a* of the toner transport screw 3. Further, as shown in FIGS. 2, 3A, and 3B, the toner transport screw 3 is journaled by bearing portions 10 at both the ends thereof (in the figures, only one bearing portion is illustrated).

Figure 2:
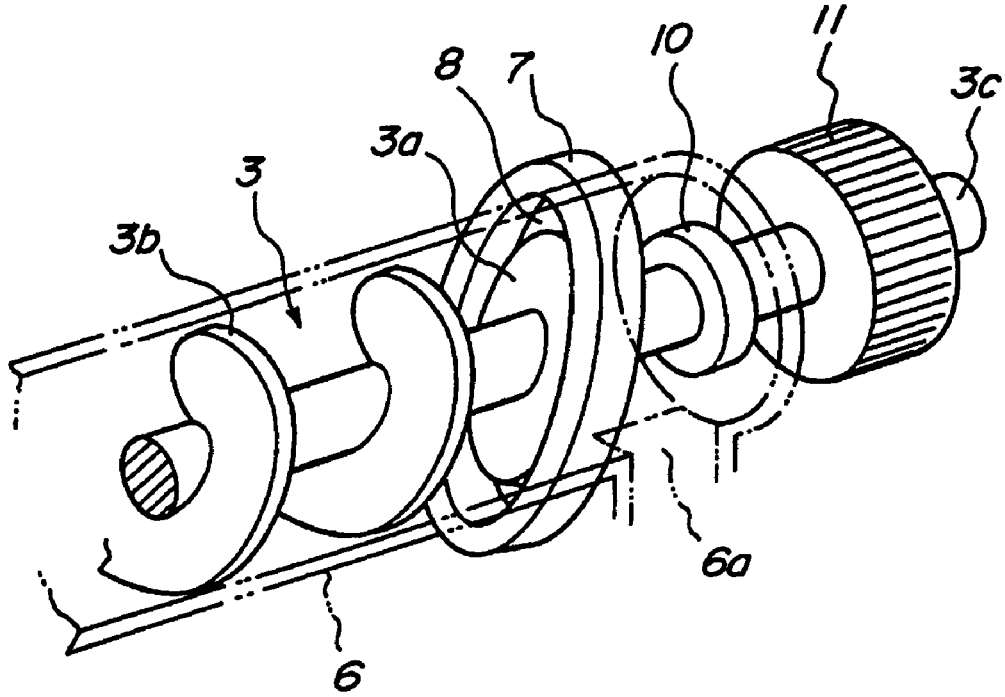
FIG. 2 is a perspective view of the toner transport screw according to the first embodiment when it is at rest.
Figure 3:
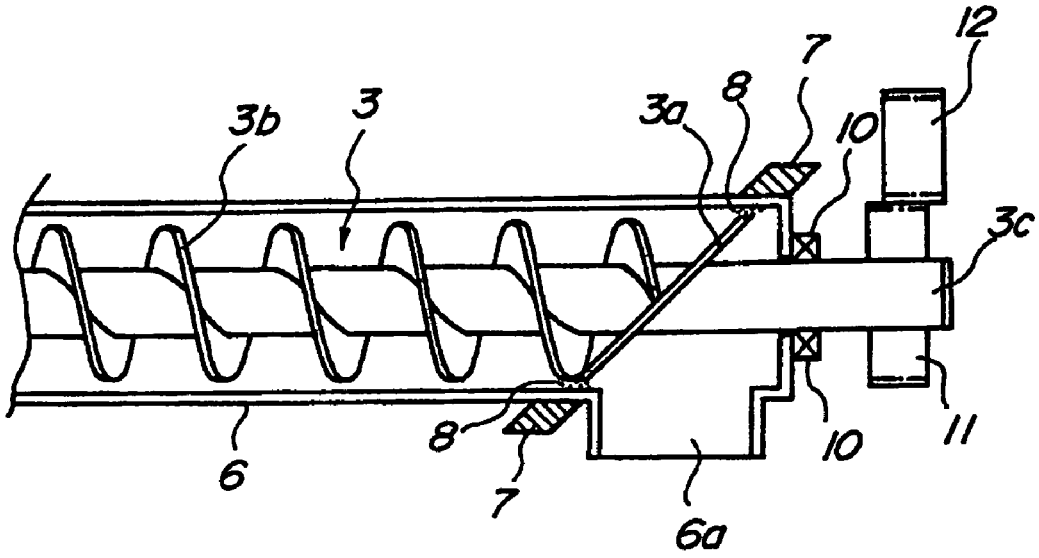
FIGS. 3A and 3B are sectional views explaining the toner transport screw according to the first embodiment when it is at rest and while it replenishes toner (rotates).
Figure 3:
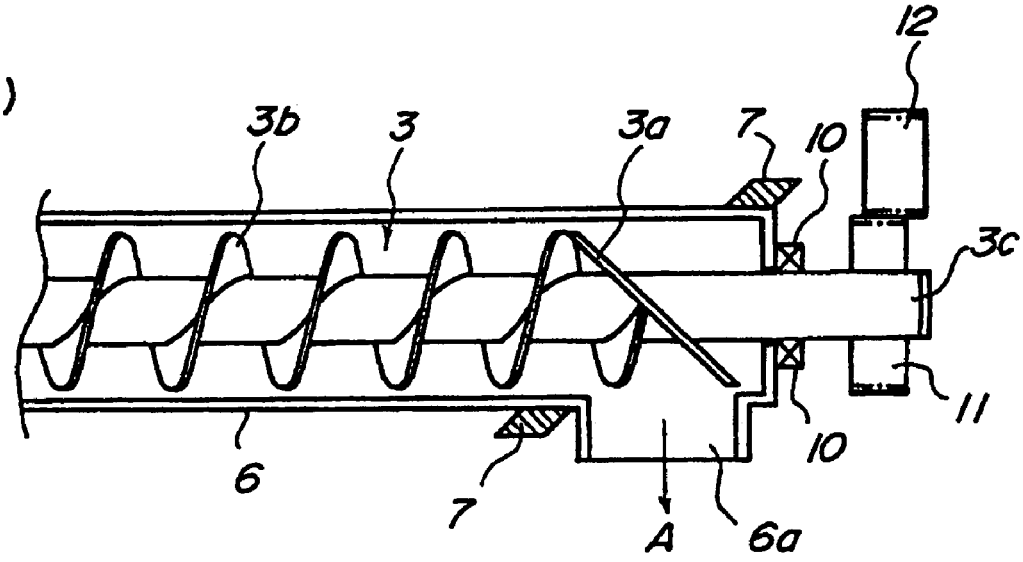

As shown in FIGS. 2, 3A, and 3B, the toner discharge port 6*a* is disposed to the toner transport pipe 6 as the developer replenishment path to discharge toner to the development unit 4. Further, a toner inlet port is disposed to the toner transport pipe 6 on a side opposite to the toner discharge port 6*a* in a lengthwise direction to transport fresh toner in the toner cartridge into the toner transport pipe 6. Further, a magnet 7 as a magnetic seal member is disposed to the toner transport pipe 6 to form a magnetic seal 8 between it and the magnetic shutter portion 3*a* by confronting with the magnetic shutter portion 3*a*. As shown in FIG. 3A, the magnet 7 is disposed to a confronting portion of the toner transport pipe 6 with which the magnetic shutter portion 3*a* confronts when the toner discharge port 6*a* is shielded by the magnetic shutter portion 3*a*.

Further, as shown in FIGS. 2, 3A, and 3B, the magnet 7 is formed in an approximately elliptic ring-shape, and the magnetic shutter portion 3*a*, which confronts with the magnet 7, is formed in an approximately elliptic shape around the inner peripheral shape of the toner transport pipe 6 in which the magnet 7 is disposed.

In the developer replenisher according to the first embodiment, the rotation of the toner transport screw 3 is stopped at a position where the magnetic shutter portion 3*a* shields the toner discharge port 6*a* as well as confronts with the magnetic seal member.

In the first embodiment, the magnetic shutter portion 3*a* and the magnet 7 are disposed together in the vicinity of the toner discharge port 6*a* of the toner transport pipe 6 to the development unit, and the magnetic seal member (magnet 7) on one hand has magnetic force, and the magnetic shutter member (magnetic shutter portion 3*a*) on the other hand has magnetism to form the magnetic seal 8 by causing theses members to confront with each other. However, the present invention is by no mans limited to the above arrangement, and the magnetic shutter member on the one hand may have magnetic force and the magnetic seal member on the other hand may have magnetism, or both the magnetic shutter member and the magnetic seal member may have magnetic force. That is, any arrangement may be employed as long as the magnetic seal is formed at a position where both the members confront with each other, and they may be appropriately arranged according to an application thereof (for example, according to a developer to be used).

As described above, not only the toner discharge port 6*a* from the toner transport pipe 6 to the development unit is shielded but also the magnetic seal 8 is formed between the magnetic shutter portion 3*a* and the magnet 7 by causing the magnetic shutter portion 3*a* disposed to the toner transport screw 3 to confront with the magnet 7 disposed to the toner transport pipe 6. Accordingly, a shield wall (shielding between both the members 3*a* and 7) for an agent having magnetism can be also formed by the magnetic seal 8. With the above arrangement, when the rotary development device is driven in rotation, the toner as the developer can be prevented from shifting between the developer replenisher and the development unit, thereby excessive replenishment and back flow of the toner can be prevented. Any of a one-component toner and a two-component toner may be used as the developer (toner) used in the present invention, and the shield wall is formed of the magnetic seal 8 to an agent having magnetism (toner in the one-component toner and a carrier in the two-component toner) can be formed in the magnetic seal 8. In the one-component toner, there is known, for example, toner composed of a resin mixed with very small magnetic substances. Further, in the two-component toner, there is toner using mixed powder of toner (non-magnetic resin) and a carrier (magnetic substances). Further, in the two-component toner in which a carrier is not previously mixed with toner (arrangement in which only toner is replenished) or in the one-component toner without magnetism (non-magnetic one-component toner), a shield wall for an agent having magnetism can be formed likewise by mixing an agent such as a carrier, and the like having magnetism with the magnetic seal 8 when the developer replenisher is assembled (by applying the agent to any one or both of the magnetic shutter portion 3*a* and the magnet 7).

The magnetic shutter portion 3*a* composed of a substance having magnetic characteristics can be made at low cost by using an ordinary rolled sheet metal, a resin having magnetic characteristics (resin containing iron powder), and the like. When, for example, the magnetic shutter portion 3*a* is composed of an iron sheet metal, it can be molded integrally with the screw portion 3*b* and the shaft portion 3*c* when they are molded of a resin. In the first embodiment, since the seal member on the one hand is the member (magnet) having the magnetic force, when the magnetic shutter portion 3*a* has magnetic characteristics, the magnetic seal 8 acting as the shield wall for the agent having the magnetism can be formed, thereby the effect of the present invention can be obtained.

FIG. 3A shows the toner transport screw 3 when it is at rest. The toner transport screw 3 is stopped at the position where the magnetic shutter portion 3*a* confronts with the magnet 7. Toner neither shifts (flows back) from the development unit to the toner discharge port 6*a* of the toner transport pipe 6 nor shifts (is excessively replenished) from the toner discharge port 6*a* of the toner transport pipe 6 to the development unit by forming the magnetic seal 8 with the both the members 3*a* and 7 in confrontation with each other. FIG. 3B shows the toner transport screw 3 while it is in rotation and the amount of toner replenished from the toner discharge port 6*a* to the development unit is maximized. The toner transported by the screw portion 3*b* is replenished from the toner discharge port 6*a* to the development unit when the magnetic shutter portion 3*a* is located at a position other than the position shown in FIG. 3A.

When the rotation of the toner transport screw 3 is stopped, it is stopped at the position shown in FIG. 3A at all times. Note that when the rotation of the toner transport screw 3 is stopped, the toner transport screw 3 is stopped at the position shown in FIG. 3A which is a position where the magnetic shutter portion 3*a* shields the toner discharge port 6*a* as well as confronts the magnet 7. In the first embodiment, there is provided a rotation control means (control means) 70 to control the rotation of the toner transport screw 3 so that it is stopped at the stop position shown in FIG. 3A at all times. In the rotation control means 70 of the first embodiment, a transmission gear 12, which transmits drive force to a toner transportation screw drive gear 11 of the toner transport screw 3, is assembled in the state that the phase thereof is previously adjusted so that the transmission gear 12 is stopped at the above position, and when toner is replenished, the toner transport screw 3 is controlled such that it is stopped after it rotates an integral multiple number of times. For example, when the toner transport screw 3 is assembled, it rotates the integral multiple number of tomes at all times to replenish toner in the state shown in FIG. 3A. With this arrangement, when the rotation of the toner transport screw 3 is stopped, it is placed in the state shown in FIG. 3A at all times.

Further, the stop position control of the toner transport screw 3 is not limited to the integral multiple rotation control, and the toner transport screw 3 may be stopped at the position shown in FIG. 3A at all times when its rotation is stopped by disposing, for example, a flag member (encoder member) at an end of the toner transport screw 3 and detecting a home position by detecting the flag member with a detection means such as a light sensor, and the like. According to this arrangement, the toner transport screw 3 can be stopped at the position shown in FIG. 3A at all times without executing the integral multiple rotation control.

As described above, according to the first embodiment, the toner discharge port 6*a* is shielded as well as the magnetic seal 8 is formed between the magnetic shutter portion 3*a* and the magnet 7 by causing the magnetic shutter portion 3*a*, which shields the toner discharge port 6*a* to confront with the magnet 7 disposed to the confronting portion of the toner transport pipe 6. Accordingly, toner can be prevented from being replenished (excessively) to the development unit from the toner transport pipe 6 when the rotary development device 4 is driven in rotation (when the rotation of the toner transport screw 3 is stopped) even in the image forming apparatus 40 provided with the rotary development device 4 for switching a plurality of development units. Further, toner is also prevented from shifting (flowing back) from the development unit to the toner transport screw 3. Since the excessive replenishment and the back flow of toner can be prevented when the rotation of the toner transport screw 3 is stropped, the toner accommodated in a pitch of the toner transport screw 3 can be stably replenished to the development unit. Further, it is not necessary to provide any valve to prevent the back flow of toner from the development unit to the toner cartridge.

[Second Embodiment]

Figure 5:
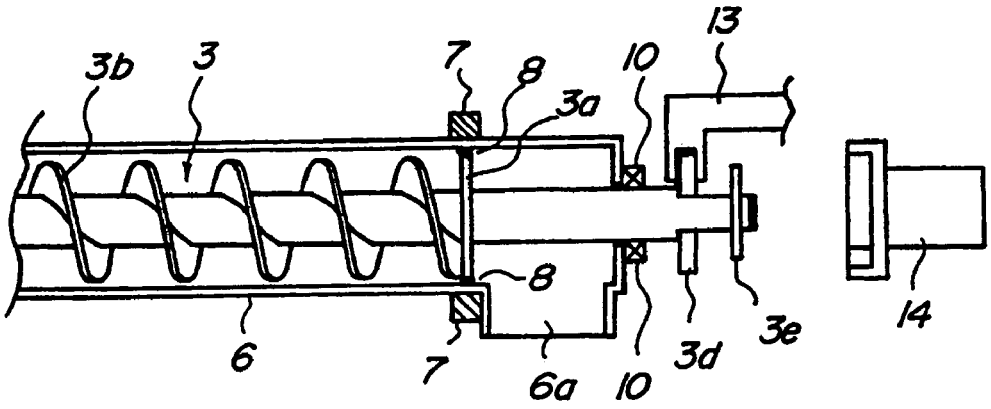
FIGS. 5A and 5B are sectional views explaining a toner transport screw according to a second embodiment when it is at rest and while it replenishes toner (rotates).
Figure 5:
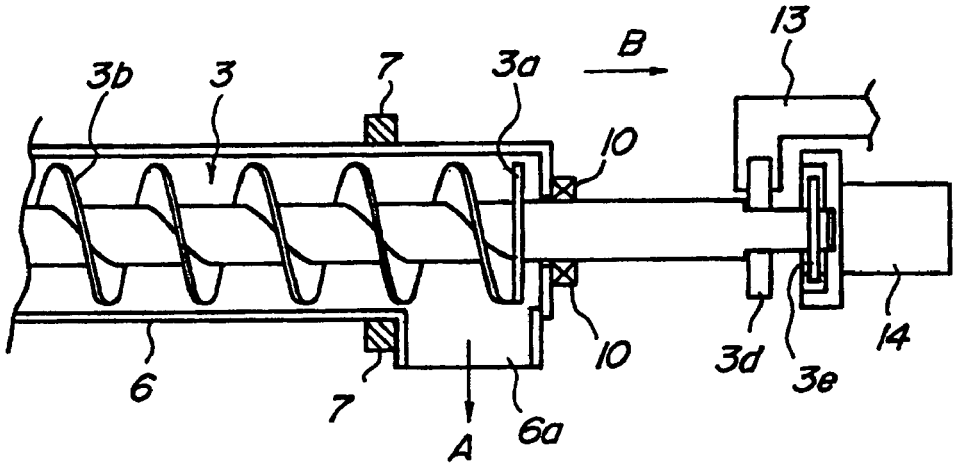

Next, a second embodiment of the present invention will be explained using FIGS. 5A and 5B. FIG. 5A is a sectional view explaining a toner transport screw according to the second embodiment when it is at rest, and FIG. 5B is a sectional view explaining the toner transport screw while it replenishes toner (rotates). Note that members having the same functions as those of the first embodiment are denoted by the same reference numerals, and detailed description thereof is omitted.

In the second embodiment, a magnetic shutter portion 3*a* as a developer shutter member disposed to a toner transport screw 3 is formed in an approximately circular shape around the inner peripheral shape of a toner transport pipe 6 to which a magnet 7 as a magnetic seal member is disposed. A position control means is disposed at a position (position shown in FIG. 5A), at which the magnetic shutter portion 3*a* shields a toner discharge port 6*a* when the rotation of the toner transport screw 3 is stopped and which confronts with the magnetic seal member, to move the toner transport screw 3 in a lengthwise direction (thrust direction).

When the toner transport screw 3 is at rest, the position control means not only stops the magnetic shutter portion 3*a* at a position where it is caused to confront with the approximately circular ring-shaped magnet 7 and shields the toner discharge port 6*a* with the magnetic shutter portion 3*a* but also forms a magnetic seal 8 between the magnet 7 and the magnetic shutter portion 3*a* which confront with each other as shown in FIG. 5A. In this state, a rotary development device rotates (revolves) to switch development units.

When the toner transport screw 3 rotates, it is moved in the thrust direction from the stop position shown in FIG. 5A to thereby open the toner discharge port 6*a* so that toner can be transported into the development unit as shown in FIG. 5B. After the toner transport screw 3 is moved to the rotational position shown in FIG. 5B, toner is transported in the direction of an arrow A by the rotation of the toner transport screw 3.

The position control means of the second embodiment for moving the toner transport screw 3 of the second embodiment in the thrust direction will be explained. The toner transport screw 3 includes a toner transport screw shaft 3*c*, and an approximately disc-shaped movement regulation member 3*d* and a movement body 13 are disposed to an end of the shaft portion 3*c*, the movement body 13 being engaged with the movement regulation member 3*d* and movable in the thrust direction. Further, a pin portion 3*e* is disposed to the end of the shaft portion 3*c* so as to be engaged with a coupling member 14 for transmitting drive force from an apparatus main body.

When toner is replenished, the movement body 13 is moved in the thrust direction (direction shown by an arrow B) to thereby move the toner transport screw 3 to a position shown in FIG. 5B. With the above movement, rotation drive force for rotating the toner transport screw 3 can be transmitted by the engagement of the pin portion 3*e* disposed to the end of the toner transport screw 3 with a coupling member 20 on the apparatus main body side.

When replenishment of toner is stopped, the movement body 13 is moved in the thrust direction (opposite to the direction of the arrow B) in a procedure opposite to the above procedure, the magnetic shutter portion 3*a* of the toner transport screw 3 is caused to confront with the magnet 7 as shown in FIG. 5A, and the toner discharge port 6*a* is shielded as well as the magnetic seal 8 is formed between both the members 3*a* and 7. With the above operation, excessive replenishment of toner to the development unit and back flow of toner to a toner cartridge can be prevented.

Note that a rack and pinion system, which uses various actuators such as a solenoid, and the like, and motors, a mechanism using a cam and a link, a mechanism using a lead screw as in a third embodiment described later, and the like can be utilized as a moving means for moving the movement body 13 in the thrust direction.

As described above, according to the second embodiment, since the system for controlling the toner transport screw 3 to rotate it the integer multiple number of times as in the first embodiment described above is not employed, the toner transport screw 3 can be rotated to replenish a necessary amount of toner. Accordingly, in the second embodiment, not only toner can be replenished more stably but also it can be more stably transported in a necessary amount of toner than the first embodiment.

[Third Embodiment]

Figure 6:
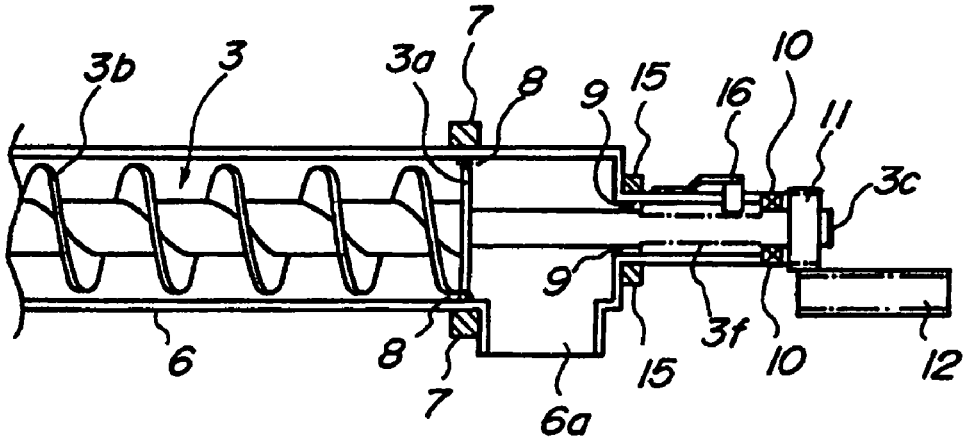
FIGS. 6A and 6B are sectional views explaining a toner transport screw according to a third embodiment when it is at rest and while it replenishes toner (rotates).
Figure 6:
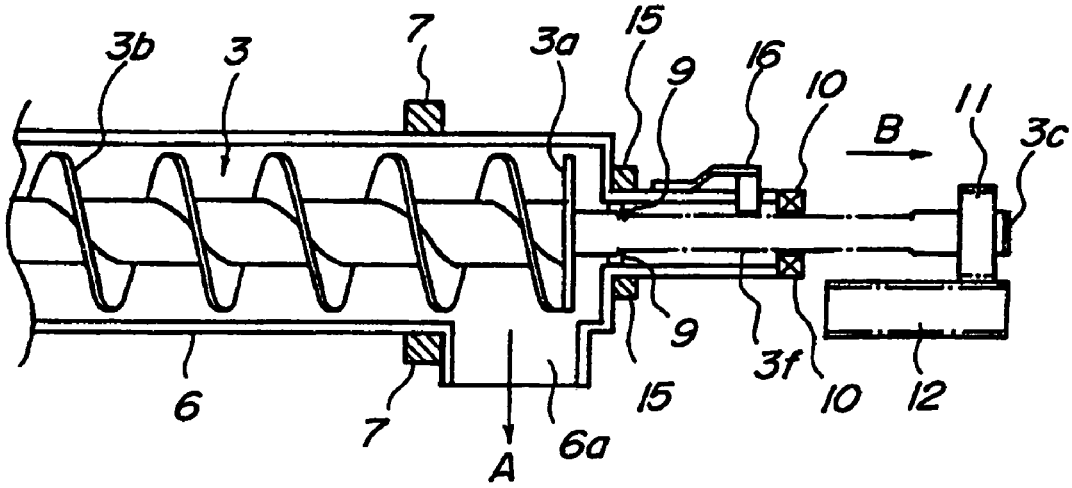
Figure 7:
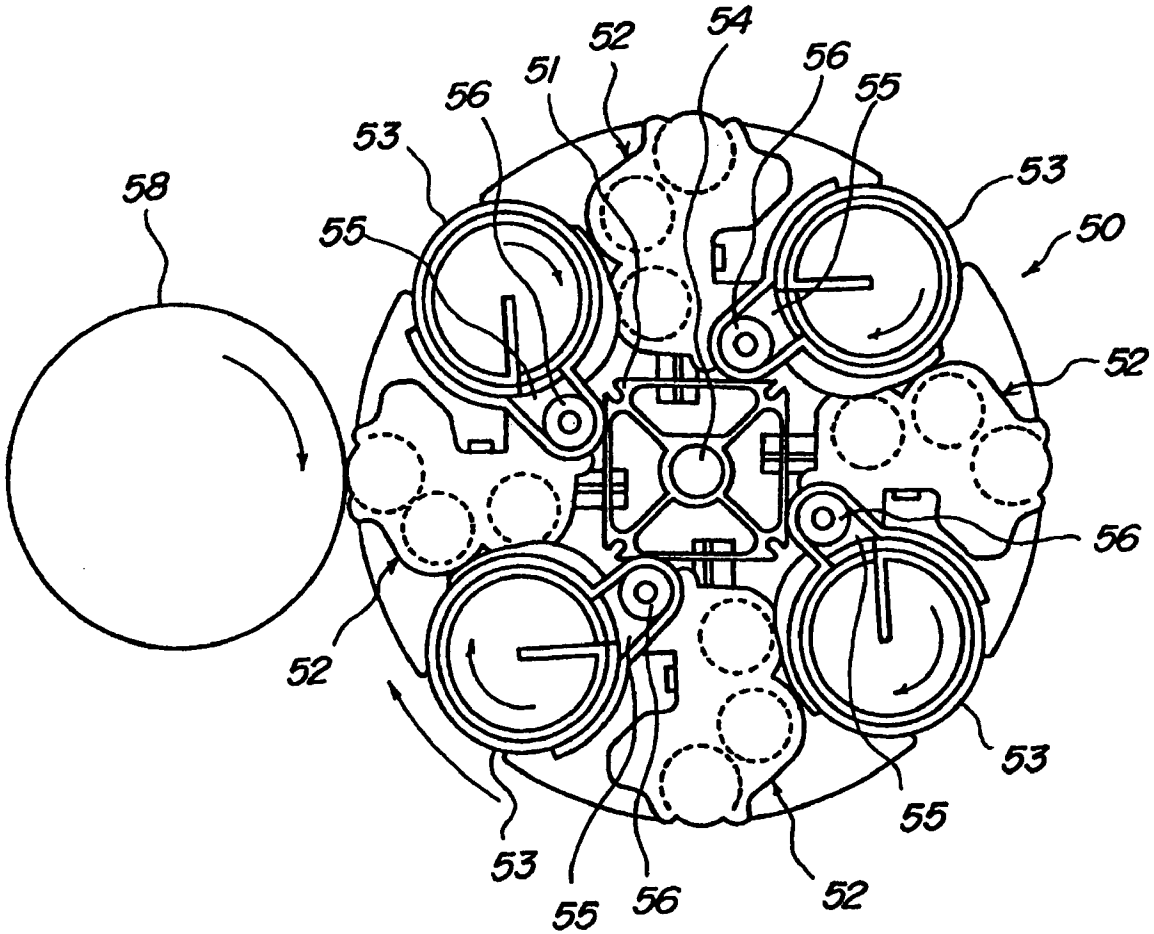
FIG. 7 is a side sectional view showing a schematic arrangement of a conventional rotary development device.
Figure 8:
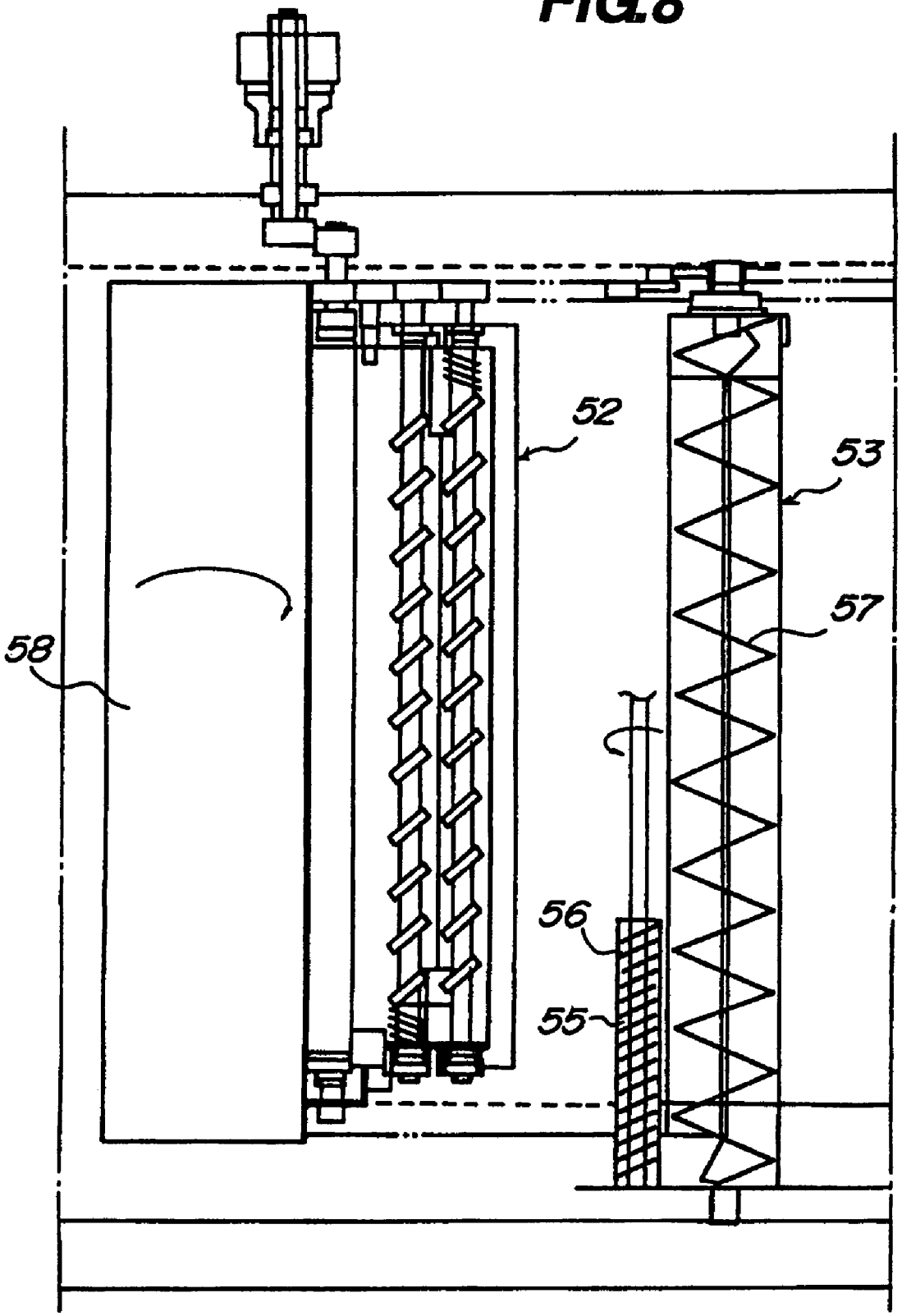
FIG. 8 is a plan view explaining a lengthwise arrangement of the conventional rotary development device.

Next, a third embodiment of the present invention will be explained using FIGS. 6A and 6B. FIG. 6A is a sectional view explaining a toner transport screw according to the third embodiment when it is at rest, and FIG. 6B is a sectional view explaining the toner transport screw while it replenishes toner (rotates). Note that members having the same functions as those of the first embodiment are denoted by the same reference numerals, and detailed description thereof is omitted.

The third embodiment is provided with an arrangement for preventing toner from getting into a thrust sliding surface of a bearing portion 10 of a toner transport screw 3, in addition to the arrangement described in the second embodiment.

More specifically, as shown in FIGS. 6A and 6B, the third embodiment is arranged such that a magnet 15 as a second magnet seal member is disposed to a toner transport pipe 6 at a position near to a toner discharge port 6*a* located forward of the bearing portion 10 of the toner transport screw 3 in a lengthwise moving direction of the toner transport screw 3, the portion, which confronts with the magnet 15, of a shaft portion 3*c* of the movable toner transport screw 3 is composed of a member having magnetic force or magnetism, and a second magnetic seal 9 different from a first magnetic seal 8 is formed between the magnet 15 and the shaft portion 3*c* confronting the magnet 15.

According to the third embodiment, even if the toner transport screw 3 is thrust moved from the state shown in FIG. 6A to the state shown in FIG. 6B or even if it is thrust moved from the state shown in FIG. 6B to the state shown in FIG. 6A, the second magnetic seal 9 is formed at all times.

Accordingly, even if toner scatters while the toner transport screw 3 rotates, the second magnetic seal 9 prevents the toner from getting in the thrust sliding surface of the bearing portion 10 of the toner transport screw 3.

Since it is sufficient that the portion, which confronts with the magnet 15, of the shaft portion 3*c* of the toner transport screw 3 be provided with magnetic characteristics, the shaft portion 3*c* may be molded of a resin, and a part of the shaft portion 3*c* may be formed of a material having the magnetic characteristics. For example, a ring member composed of magnetic metal may be molded integrally with the resin when the resin is molded, or the surface of the shaft portion 3*c* molded of the resin may be subjected to a surface treatment such as plating with magnetic characteristics. The shaft portion may be composed of a resin material having magnetic characteristics as described in the first embodiment.

Note that the second magnetic seal member that forms the second magnetic seal 9 and a part of a developer transport means confronting with the second seal member are arranged such that the magnetic seal member (magnet 15) on one hand has magnetic force, and a part of the developer transport means on the other hand (part of the shaft portion 3*c* confronting with the magnet) has magnetism. However, the present invention is by no means limited to the above arrangement, and the magnetic seal member on the one hand has magnetism and a part of the developer transport means on the other hand may have magnetic force, or both the magnetic seal member and a part of the developer transport means may have magnetic force. That is, any arrangement may be employed as long as the second seal member is formed at a position where both the members confront with each other.

Note that a magnetic shutter portion 3*a* (first developer shutter member) and a magnet 7 (first magnetic seal member) that form the first magnetic seal 8, which is the first magnetic seal described in the second embodiment, are arranged similarly to the second embodiment also in the third embodiment.

That is, when the toner transport screw 3 is at rest, the magnetic shutter portion 3*a* is stopped at a position where it is caused to confront with the approximately circular ring-shaped magnet 7, thereby not only the toner discharge port 6*a* is shielded with the magnetic shutter portion 3*a* but also the magnetic seal 8 is formed between the magnet 7 and the magnetic shutter portion 3*a* which confront with each other as shown in FIG. 6A. In this state, a rotary development device rotates (revolves) to switch development units. At the time, the second magnetic seal 9 is formed between the magnet 15 as the second magnetic seal member and the shaft portion 3*c* of the toner transport screw 3 confronting with the magnet 15, thereby toner is prevented from getting in the thrust sliding surface of the bearing portion 10 of the toner transport screw 3.

When the toner transport screw 3 rotates, it is moved in a thrust direction (direction shown by an arrow B) from the stop position shown in FIG. 6A to thereby open the toner discharge port 6*a* as shown in FIG. 6B so that toner can be transported into a development unit. After the toner transport screw 3 is moved to the rotational position shown in FIG. 6B, toner is transported in the direction of an arrow A by the rotation of the toner transport screw 3. At the time, the second magnetic seal 9 is also formed between the magnet 15 as the second magnetic seal member and the shaft portion 3*c* of the toner transport screw 3 confronting with the magnet 15, thereby toner is prevented from getting in the thrust sliding surface of the bearing portion 10 of the toner transport screw 3 even if it scatters while the toner transport screw 3 rotates.

A position control means of the third embodiment for moving the toner transport screw 3 in the thrust direction will be explained. In the third embodiment, a lead screw 3*f* and a lead screw engagement member 16 are used to move the toner transport screw 3 in the thrust direction. Further, the toner transport screw 3 is driven in rotation by rotating a drive gear 11 thereof by a transmission gear 12 on an apparatus main body side.

The lead screw 3*f* may be driven in rotation by rotating a lead screw engagement member 22, which is engaged with the lead screw 3*f*, by a dedicated small motor. In the third embodiment, however, the lead screw 3*f* of the toner transport screw 3 is rotated by the rotation of the drive gear 11, thereby the toner transport screw 3 is moved in the thrust direction through the lead screw engagement member 22 meshed with the lead screw 3*f*.

The lead screw engagement member 22 is engaged with the lead screw 3*f* at an end thereof and arranged to have a spring property (composed of as a sheet spring here) so that it is urged against the lead screw 3*f* With this arrangement, when the toner transport screw 3 rotates in the rotational direction at the time toner is replenished, it is moved in the direction shown by the arrow B. When the toner transport screw 3 is abutted against a not shown thrust regulating portion after a predetermined thrust movement, the lead screw engagement member 22 is less engaged with the lead screw 3*f*, thereby the lead screw 3*f* rotates at idle. On the completion of replenishment of toner, the toner transport screw 3 rotates inversely, moves in a direction opposite to that shown by the arrow B, and is placed in the state shown in FIG. 6A. At the time, when the toner transport screw 3 is abutted against another not shown thrust regulating portion, the lead screw engagement member 22 is less engaged with the lead screw 3*f*, thereby the lead screw 3*f* rotates at idle.

There is toner which is liable to be degraded when the toner transport screw 3 is moved in the thrust direction as described above, because the toner is in sliding contact with a thrust swing surface of the bearing portion 10 due to its granular property. When the amount of the degraded toner increases, an image may be adversely affected thereby. The arrangement of the third embodiment is effective as a countermeasure for preventing the degradation of the toner.

According to the third embodiment described above, toner can be prevented from getting in the bearing portion 10 by forming the second magnetic seal 9 between the magnet 15 as the second seal member and the shaft portion 3*c* of the toner transport screw 3 confronting with the magnet 15, thereby the degradation of toner caused on the sliding surface between the shaft portion 3*c* and the bearing portion 10 can be prevented.

Further, the toner transport screw 3 can be rotated so as to replenish a necessary amount of toner likewise the second embodiment because the system for controlling the toner transport screw 3 to rotate it the integer multiple number of times is not employed. Accordingly, in the third embodiment, not only toner can be replenished more stably but also it can be more stably transported in a necessary amount than the first embodiment.

Other Embodiments

The embodiments described above exemplify the rotary development device having the three development units (and the development unit as a simple unit in addition to them) disposed therein to form a color image. However, the number of the development units disposed to and used by the rotary development device is not limited the above number, and the rotary development device may be provided with an appropriate number of development units as necessary, and the present invention is particularly effective as a developer replenisher in an image forming apparatus provided with the rotary development device arranged as described above.

Further, an arrangement, in which developer accommodation vessels such as detachably attachable toner cartridges, and the like are disposed in the rotary development device, an arrangement, in which fresh toner is replenished from a hopper installed in a main body of an image forming apparatus, and an arrangement, in which a fresh toner transport pipes are disposed in the rotary development device, may be also employed in the present invention.

The present invention is also effective in a tandem type color image forming apparatus having developer replenishment paths communicating the developer accommodation vessels with the development units. Since no developer is unnecessarily replenished to the development units in the above arrangement, the amount of developer in the development units can be stabilized, thereby image quality can be enhanced. In particular, the amount of developer in the development units can be stabilized by the shutter arrangement of the present invention in a flushing phenomenon which occurs when a developer have very good flowability (when it is replenished, and the like).

Further, the embodiments described above exemplify a printer as the image forming apparatus. However, the present invention is not limited thereto, and the image forming apparatus may be image forming apparatuses other than the printer such as a copy machine, a facsimile, and the like, a complex machine, and the like, in which the functions of the above devices are combined, and an image forming apparatus which uses a transfer material bearing member, sequentially overlaps respective toner color images on a transfer material born by the transfer material bearing member and transfers the toner color images. A similar effect can be obtained by applying the present invention to these image forming apparatuses.

This application claims priority from Japanese Patent Application No. 2004-33578 filed Feb. 10, 2004, which is hereby incorporated by reference herein.

The invention claimed is:

1. A development device comprising:

a developer accommodation vessel in which developers having magnetism are accommodated;

a development unit for developing electrostatic images on an image bearing member with the developers;

a developer replenishment path for establishing communication between the developer accommodation vessel and the development unit and supplying the developers to the development unit from a discharge port;

a transport member rotatably disposed in the developer replenishment path to transport the developers to the development unit;

drive means for driving the transport member;

a movement body for holding and moving the developer accommodation vessel, the development unit, and the developer replenishment path;

a shield member movable integrally with the transport member and capable of shielding the discharge port;

a magnetic seal member disposed in the developer replenishment path to hold the developers by a magnetic field formed between the magnetic seal member and the shield member when the shield member is located at a position confronting the magnetic seal member; and control means for controlling the drive means such that the shield member stops at the confronting position when the transport member is stopped.

2. A development device according to claim 1, wherein:

the shield member is formed in an approximately elliptic shape around the inner periphery of the developer replenishment path and disposed of so as to incline with respect to a rotary axis of the transport member; and the control means controls the drive means to stop the rotation of the transport member such that the shield member stops at the confronting position when the transport member is stopped.

3. A development device according to claim 1, wherein:

the shield member is formed in an approximately circular shape around the inner periphery of the developer replenishment path; and the control means controls the drive means to move the transport member in a direction of a rotary axis of the transport member such that the shield member stops at the confronting position when the transport member is stopped.

4. A development device according to claim 1, wherein both the shield member and the magnetic seal member provide magnetic force.

5. A development device according to claim 1, wherein one of the shield member and the magnetic seal member provides magnetic force and the other of the shield member and the magnetic seal member is magnetic.

6. A development device according to claim 2, wherein both the shield member and the magnetic seal member provide magnetic force.

7. A development device according to claim 2, wherein one of the shield member and the magnetic seal member provides magnetic force and the other of the shield member and the magnetic seal member is magnetic.

8. A development device according to claim 3, wherein both the shield member and the magnetic seal member provide magnetic force.

9. A development device according to claim 3, wherein one of the shield member and the magnetic seal member provides magnetic force and the other of the shield member and the magnetic seal member is magnetic.

* * * * *

UNITED STATES PATENT AND TRADEMARK OFFICE

CERTIFICATE OF CORRECTION

PATENT NO. : 7,167,668 B2
APPLICATION NO. : 11/046806
DATED : January 23, 2007
INVENTOR(S) : Hajime Sekiguchi It is certified that error appears in the above-identified patent and that said Letters Patent is hereby corrected as shown below:

ON THE TITLE PAGE:
At Item (57), Abstract, Line 19, "with" should be deleted.

COLUMN 4:
Line 57, "operation" should read --operations--.

COLUMN 5:
Line 13, "transport" (second occurrence) should read --transports--.
Line 62, "mans" should read --means--.

COLUMN 7:
Line 20, "tomes" should read --times--.
Line 55, "stropped," should read --stopped,--.

COLUMN 10:
Line 63, "as" should be deleted.
Line 64, "screw 3f" should read --screw 3f.--.

COLUMN 11:
Line 34, "than" should read --than in--.
Line 55, "a" should be deleted.

COLUMN 12:
Line 2, "have" should read --has--.
Line 18, "No. 2004-33578" should read --No. 2004-033578--.

Signed and Sealed this

Twenty-fifth Day of December, 2007

JON W. DUDAS
*Director of the United States Patent and Trademark Office*